United States Patent [19]

Bauer et al.

[11] 4,444,414

[45] Apr. 24, 1984

[54] APPARATUS FOR FACILITATING AN ADJUSTMENT OF FRONT AND/OR REAR JAWS OF SKI BINDINGS

[75] Inventors: Helmut Bauer; Erwin Krob, both of Vienna, Austria

[73] Assignee: TMC Corporation, Baar, Switzerland

[21] Appl. No.: 372,403

[22] Filed: Apr. 27, 1982

[30] Foreign Application Priority Data

Apr. 28, 1981 [AT] Austria ..... 1893/81

[51] Int. Cl.[3] ..... A63C 9/08

[52] U.S. Cl. ..... 280/633

[58] Field of Search ..... 280/633, 636, 607; 24/68 A, 344, 345; 403/104, 107, 380

[56] References Cited

U.S. PATENT DOCUMENTS

| | | | |
|---|---|---|---|
| 3,807,748 | 4/1974 | Ramillon | 280/633 |
| 3,913,931 | 10/1975 | Kratky | 280/633 X |
| 3,950,001 | 4/1976 | Weigl | 280/633 X |
| 3,995,880 | 12/1976 | Murata | 280/633 X |
| 4,157,193 | 6/1979 | Beyl | 280/633 |

FOREIGN PATENT DOCUMENTS

| | | | |
|---|---|---|---|
| 276180 | 2/1969 | Austria | 280/633 |
| 2516985 | 4/1976 | Fed. Rep. of Germany | 280/633 |
| 2617395 | 11/1977 | Fed. Rep. of Germany | 280/633 |
| 2635409 | 2/1978 | Fed. Rep. of Germany | 280/633 |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

An apparatus for facilitating an adjusting of the position of a front and/or rear jaw of a ski binding. The apparatus has a guide rail which is adapted to be secured on the upper surface of a ski with the jaw being movable along the guide rail. One of the guide rail and the jaw is provided with a toothed bar which extends perpendicularly with respect to the upper surface of the ski. The other of the guide rail and the jaw has a tooth detent arranged movably in a transverse direction of the ski. A spring is provided for biasing the tooth detent into engagement with the toothed bar. The tooth detent is provided at the end of a single lever pivotally supported on an axle which extends in longitudinal direction of the ski on the side surface of the housing of the jaw, which side surface is adjacent the toothed bar of the guide rail.

14 Claims, 6 Drawing Figures

APPARATUS FOR FACILITATING AN ADJUSTMENT OF FRONT AND/OR REAR JAWS OF SKI BINDINGS

FIELD OF THE INVENTION

The invention relates to an apparatus for facilitating an adjustment of the front and/or rear jaws of ski bindings, comprising a guide rail which is fastened on the upper surface of a ski and a jaw which is movable along the guide rail, wherein the one of these two members is provided with a toothed bar which extends perpendicularly with respect to the upper surface of the ski and which is engaged by a tooth detent which is under the influence of a spring, preferably a compression spring and is movably arranged in transverse direction of the ski on the other member.

BACKGROUND OF THE INVENTION

In the conventional apparatus of this type (see German OS No. 25 16 985) the toothed bar is secured on the jaw and a slide member is housed in the guide rail, which slide member is movable in transverse direction of the ski against the force of a spring and which, in the locked position of the jaw, engages with its tooth detent the teeth of the toothed bar. In order to initiate an adjustment of the jaw, one therefore had to hold onto the ski with the left hand and press with the thumb of the same hand the slide member back against the force of the spring and thereafter adjust the jaw with the right hand. The slide member was thereafter released by the thumb. Thus at all times both hands were needed for the adjusting operation.

To overcome this disadvantage it has been suggested to arrange inside of a jaw which is movable along a guide rail two levers symmetrically and at an acute angle with respect to a vertically oriented longitudinal center plane of the ski, which levers are under the influence of springs and engage with their ends which carry tooth detents thereon a toothed bar, in this insatance, a bar whih is toothed on both sides (compare German OS No. 26 17 395). In orderto spread apart the two levers to effect a release of the lock, the end of a ski pole has to be guided between the two levers. The jaw itself is moved by the tip of the ski pole being introduced into the hole of a row of holes in the toothed bar and the ski pole being used as a lever for effecting the forward moving of the jaw. This operation is repeated when needed until the desired position of the jaw is reached. The adjusting operation is very difficult. Furthermore, it is generally common to carry out the adjustment of the position of the jaw at a point in time at which the user has not yet entered with his boot the binding.

Finally, an adjusting apparatus for rear jaws has become known (see Austrian Pat. No. 359,406,which corresponds to U.S. Pat. No. 4,157,193), in which a massive hand lever projects from the rear end of the jaw member and is connected to a locking member engaged with a rack on a guide rail. Obviously this lever is exposed to the risk of erroneously being opened during skiing. Therefore, it was necessary to build in a safety mechanism which, when the ski boot had been inserted, made a swinging of the hand lever impossible. For this purpose, the jaw has to be supported for movement in the longitudinal direction of the ski. The suggested adjusting apparatus was thus not only compendious, it also was limited to a special type of ski binding, namely, those which were adjusted against the force of a spring, as soon as the user stepped into the binding with the skit boot.

The object of the invention is to overcome the disadvantages of the conventional adjusting apparatus and to provide an apparatus of the above-disclosed type, which is simple in its design and is inexpensive to manufacture and which moreover can be operated with one signle hand. Furthermore the apparatus is to be usable universally, thus with all types of jaws.

SUMMARY OF THE INVENTION

This object is achieved according to the invention primarily by the tooth detent being provided at the end of one single lever pivotal about an axle which extends in longitudinal direction of the ski on the side surface of the housing of the jaw, which side surface is adjacent to a toothed bar on a guie rail.

In order to thereby avoid a projecting of the parts from the side surface of the housing, it has proven to be advantageous if, according to a further characteristic of the invention, the lever is arranged in a groove or recess in the sidewall of the housing. A different characteristic of the invention also aims in this direction, namely that the lever—viewed in longitudinal cross section—is constructed approximately L-shaped and is aligned or lies in a common plane in the engaged position of the tooth detent with the adjacent sidewall of the housing. The sidewall by no means needs to be flat as it can also be constructed arched or can be defined by two flat surfaces which define an obtuse angle.

Of course various structures can be provided to limit the angle of traverse of the lever. However, it has been proven as particularly simple and reliable if, in a further development of the invention, a stop is provided on the backside of the tooth detent, which stop limits the angle of traverse of the lever. In this manner a swinging out of the lever beyond the toothed bar is reliably stopped and moreover an orderly engagement of teeth of the tooth detent and toothed bar is brought about. This effect is yet reinforced if, according to a further characteristic of the invention, a compression spring is supported at one end on the stop and the other end is housed in a hole in the housing. Of course it is possible to mount the support of the spring on the stop by providing a blind hole or a pilot bar.

Finally it has been proven as advantageous if, in a further development of the invention, a groove or recess is provided on the outer side of the lever, which recess or groove facilitates a better engagement of the thumb of the hand of the user. In this manner the risk of the thumb sliding off from the outer side of the lever is with certainty avoided.

BRIEF DESCRIPTION OF THE DRAWINGS

The drawing schematically illustrates an exemplary embodiment of an inventive apparatus. That is.

DETAILED DESCRIPTION

Figure 1:
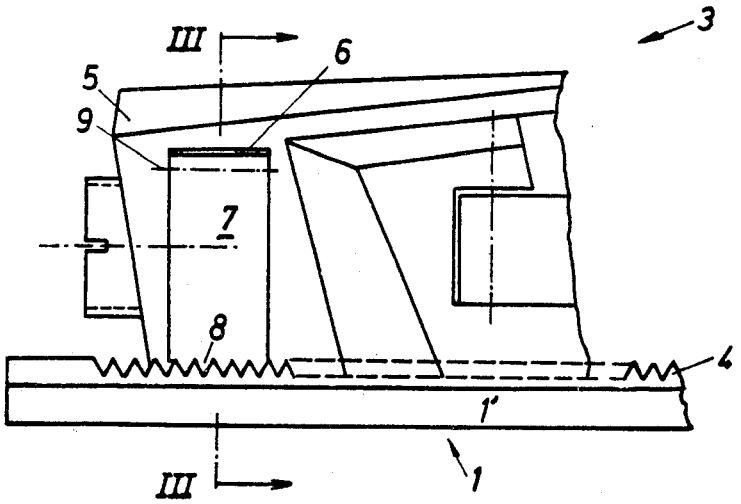
FIG. 1 illustrates the region of a front jaw equipped with the inventive apparatus and in the locked position relative to the guide rail.

The apparatus consists of a guide rail 1 adapted to be mounted on the upper surface of a ski and on which a front jaw 3 is movably guided. The front jaw 3 is equipped with guide tracks 2. The guide rail 1 is designed approximately U-shaped having a base part 1A and the tracks 2 are defined by a pair of laterally spaced legs 1' at the edges of the base part 1A and which have inwardly directed flanges 1''. A vertically upright toothed bar or rack 4 is provided on one of the flanges 1'' adjacent the inner end thereof, namely, the right one in FIGS. 2 and 3.

An opening or recess 6 is provided in a vertical sidewall of the housing part 5 of the front jaw 3. A lever 7, which has a downwardly projecting tooth detent 8 thereon at its lower end, is pivotally supported for movement about an axle 9 located adjacent the upper side of the recess 6. Thus, the lever depends downwardly from the axle 9. A stop member 10 is arranged, for example soldered, on the backside of the tooth detent 8 and functions to limit the angle of traverse of the lever 7 about the axis of the axle 9 and moreover ensures an orderly engagement of the teeth on the tooth detent 8 and on the toothed bar 4. However, it would also be possible to construct the lever and the stop member in one piece, for example to manufacture it as a precision cast piece or to injection mold it with a plastic material. Furthermore the housing 5 has, in the region which is opposed to the stop member 10, a horizontally extending blind hole 11 into which is housed one end of a compression spring 12. The other end of the spring 12 engages the stop member 10. In the alternative, the stop member can for this purpose be provided with a blind hole 10*a* (see FIG. 2*c*) receiving the spring therein or provided with a pilot or guide bar 10*b* (see FIG. 2*b*).

Figure 2:
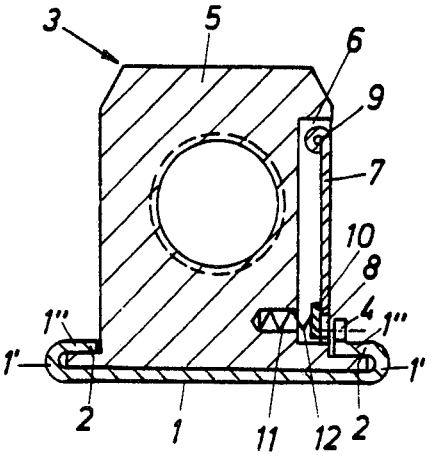
FIG. 2 is a cross-sectional view taken along the line III—III of FIG. 1 and illustrates the released position of the front jaw relative to the guide rail.
Figure 3:
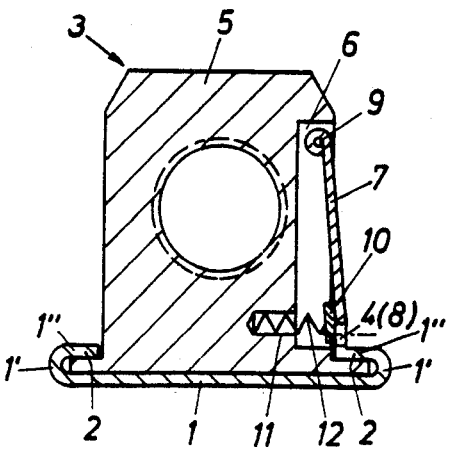
FIG. 3 illustrates a cross-sectional view taken along the line III—III of FIG. 1 and in the locked position.

As shown in FIGS. 1 and 2, the toothed bar 4 is adjacent the lower end of the vertical sidewall of the housing part 5 of the jaw 3, and in each operational position of the jaw 3 relative to the guide rail 1, a portion of the toothed bar 4 is vertically aligned with a lower portion of the recess 6. The axle 9 extends across the uppermost portion of recess 6 substantially parallel to the sidewall of the housing part 5, and the outer surface of the lever 7 is approximately parallel to and approximately flush with the side surface of the housing part 5 when the lever 7 is in the position shown in FIG. 3.

Figure 2A:
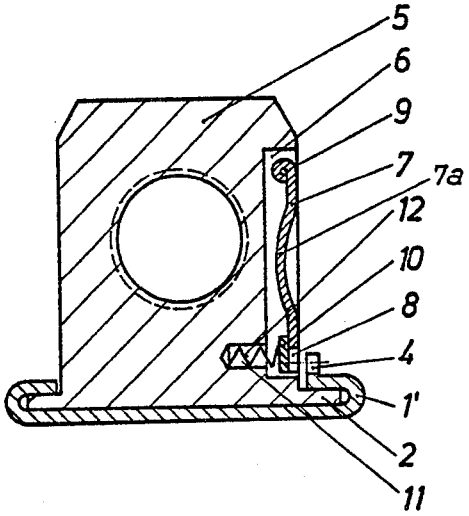
FIGS. 2*a*, 2*b* and 2*c* are similar to FIG. 2 and show respective modifications of the embodiment according to FIG. 2.
Figure 2B:
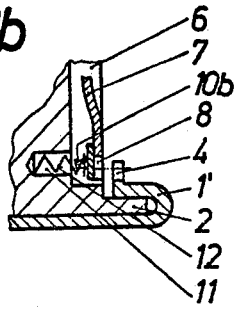
Figure 2C:
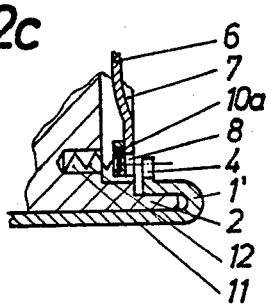

The tooth detent 8 engages the teeth on the toothed bar 4 in the locked condition of the front jaw 3. If the front jaw 3 is now supposed to be adjusted along the guide rail 1, the housing 5 of the front jaw is first gripped by the right or left hand of the user and the lever 7 is thereafter swung in FIG. 3 clockwise against the force of the compression spring 12, so that the engagement of the tooth detent 8 with the toothed bar 4 is released. It is now possible to move as desired and by the hand of the user the front jaw 3 along the guide rail 1. When the desired position of the front jaw relative to the guide rail 1 is reached, the user then lifts off the hand which grips around the front jaw 3 from the lever 7, and the tooth detent 8 again engages under the bias of the compression spring 12 the toothed bar 4. The adjusting operation is thus completed. A further modification according to FIG. 2*a* includes a recess or depression 7*a* provided on the outer surface of the lever 7 for facilitating better engagement of the lever by the thumb of the hand of the user.

If course, the invention is not to be limited to the exemplary embodiment which is illustrated in the drawing and is described hereinabove. Instead, various alternatives are possible without departing from the scope of the invention. For example, inventive adjusting apparatus can also be arranged in rear jaws, whereby the groove or recess for the hand lever of course must be arranged in the bearing block and not in the normally swingable binding housing. Furthermore, the use of the inventive adjusting apparatus in ski bindings wherein the front and rear jaw form a unit adjustable by itself, is also to fall within the scope of the invention.

The embodiments of the invention in which an exclusive property or privilege is claimed are defined as follows:

1. In an apparatus for adjusting the position of a ski binding jaw on a ski, including a guide rail which is adapted to be secured on an upper surface of the ski, means supporting said jaw on said guide rail for movement longitudinally of the ski, said guide rail having a toothed bar which extends longitudinally of the ski and has plural teeth projecting upwardly generally perpendicular to the upper surface of the ski, and toothed detent means supported on said jaw for movement transversely of the ski and having a spring which biases said toothed detent means toward a position in which it engages said toothed bar, the improvement comprising wherein said toothed detent means includes a lever pivotally supported on an axle which extends longitudinally of the ski and is provided on a sidewall of a housing of said jaw, said sidewall being adjacent said toothed bar of said guide rail, and at least one tooth provided on said lever at a location spaced from said axle and being movable into and out of meshing engagement with selected teeth on said toothed bar under and against the resilient urging of said spring.

2. The apparatus according to claim 1, wherein said lever is arranged in a recess provided in said sidewall of said housing.

3. The apparatus according to claim 9, wherein a stop member is provided on a side of said lever remote from said selected teeth and in the region of said one tooth and is engageable with said toothed bar to limit pivotal movement of said lever in one direction.

4. The apparatus according to claim 3, wherein said spring has one end supported on said stop member and its other end disposed in a hole provided in said housing.

5. The apparatus according to claim 4, wherein said one end of said spring is supported by one of a blind hole provided in said stop member and a guide bar provided on said stop member.

6. The apparatus according to claim 1, wherein said lever, viewed in a longitudinal cross section, is approximately L-shaped and, in said engaged position of said one tooth and said selected teeth, is aligned with said sidewall of said housing.

7. The apparatus according to claim 1, wherein a depression is provided on an outer surface of said lever to facilitate engagement of a thumb of a user with said lever.

8. An apparatus for adjusting the position of a ski binding jaw on a ski, comprising a guide rail adapted to be secured to an upper surface of the ski, said guide rail having a toothed rack which is provided along a lateral edge thereof and extends longitudinally of the ski, and means supporting said jaw on said guide rail for movement relative thereto longitudinally of the ski, said jaw including a housing having a side surface which extends upwardly from a location adjacent said toothed rack and which has an opening therein, wherein in each operational position of said jaw relative to said guide rail a portion of said toothed rack is vertically aligned with a lower portion of said opening, said jaw also including a lever which has an outer surface thereon, is supported in said opening for pivotal movement about an axis extending approximately parallel to said side surface of said jaw and has a tooth thereon at a location spaced radially from said axis, said lever being movable between a first position in which said tooth operatively engages said toothed rack and said outer surface is approximately flush with said side surface of said jaw and a second position pivoted inwardly from said first position, said tooth being free of engagement with said toothed rack in said second position, said jaw including resilient means which yieldably urges said lever toward said first position and stop means for preventing movement of said lever past said first position under the urging of said resilient means.

9. The apparatus according to claim 8, wherein said axis extends substantially horizontally across an upper end portion of said opening.

10. The apparatus according to claim 9, wherein the teeth of said toothed rack project upwardly and said tooth on said lever projects downwardly.

11. The apparatus according to claim 10, wherein said stop means includes a stop member provided on a rear side of said lever and extending downwardly past said tooth on said lever, said stop member engaging said toothed rack when said lever is in said first position in order to prevent movement of said lever past said first position in response to the urging of said resilient means.

12. The apparatus according to claim 11, wherein said lever is a substantially platelike member, and wherein said resilient means includes a helical compression spring having one end supported on said stop member and its other end supported in a blind opening in a surface of said housing.

13. The apparatus according to claim 12, including means defining a depression in said outer surface of said lever.

14. An apparatus for adjusting the position of a ski binding jaw on a ski, comprising a guide rail adapted to be secured to an upper surface of the ski, said guide rail having a toothed rack which is provided along a lateral edge thereof and extends longitudinally of the ski, and means supporting said jaw on said guide rail for movement relative thereto longitudinally of the ski, said jaw including a housing having a side surface which extends upwardly from a location adjacent said toothed rack and which has an opening therein, wherein in each operational position of said jaw relative to said guide rail a portion of said toothed rack is vertically aligned with a lower portion of said opening, said jaw also including a generally vertically extending lever disposed in said opening and supported at its upper end for pivotal movement about an axle which extends across an upper portion of said opening substantially parallel to a longitudinal axis of the ski, said lever depending from said axle and having a tooth at the lower end thereof and being movable between a position in which said tooth operatively engages said toothed rack and a position in which said tooth is free of engagement with said toothed rack.

* * * * *

UNITED STATES PATENT AND TRADEMARK OFFICE

CERTIFICATE OF CORRECTION

PATENT NO. : 4,444,414

DATED : April 24, 1984

INVENTOR(S) : Helmut Bauer et al

It is certified that error appears in the above-identified patent and that said Letters Patent is hereby corrected as shown below:

Column 4, line 40; change "claim 9" to ---claim 1---.

Signed and Sealed this

*Fourteenth* Day of *August 1984*

[SEAL]

*Attest:*

GERALD J. MOSSINGHOFF

*Attesting Officer*

*Commissioner of Patents and Trademarks*